United States Patent [19]

Tanaka et al.

[11] Patent Number: 4,809,330

[45] Date of Patent: Feb. 28, 1989

[54] ENCODER CAPABLE OF REMOVING INTERACTION BETWEEN ADJACENT FRAMES

[75] Inventors: Shunji Tanaka; Naoki Matsumura, both of Tokyo, Japan

[73] Assignee: NEC Corporation, Tokyo, Japan

[21] Appl. No.: 726,583

[22] Filed: Apr. 23, 1985

Related U.S. Application Data

[62] Division of Ser. No. 913,710, Sep. 30, 1986, Pat. No. 4,776,938.

[30] Foreign Application Priority Data

Apr. 23, 1984 [JP] Japan ..... 59-80239

[51] Int. Cl.[4] ..... G10L 5/00

[52] U.S. Cl. ..... 381/40; 381/51; 381/41

[58] Field of Search ..... 381/29–53

[56] References Cited

U.S. PATENT DOCUMENTS 4,282,405 8/1981 Taguchi ..... 381/49

4,701,954 10/1987 Atal ..... 381/49

4,716,592 12/1987 Ozawa et al. ..... 364/900

OTHER PUBLICATIONS

Viswanathan, et al., "Quantization Properties of Transmission Parameters in Linear Predictive Systems", IEEE Transations on Acousties, Speech, and Signal Processing, vol. A88P-23, No. 3, Jun. 1975, pp. 309 321.

Makhoul, "Linear Prediction: A Tutorial Review", Proceedings of the IEEE, vol. 63, No. 4, Apr. 1975, pp. 561–580.

ATAL, et al., "A New Model of LPC Excitation for Producing Natural-Sounding Speech at Low Bit Rates", Bell Laboratories to Proc. IASSP, 1982, pp. 614–617.

*Primary Examiner*—Emanuel S. Kemeny

*Attorney, Agent, or Firm*—Foley & Lardner, Schwartz, Jeffery, Schwaab, Mack, Blumenthal & Evans

[57] ABSTRACT

In a multipulse pitch speech excitation generator, pulses which may everlap the next frame are eliminated by a subtraction process (CC-HH), and pulses from the next frame which may overlap the present frame are eliminated by selection.

3 Claims, 4 Drawing Sheets

ENCODER CAPABLE OF REMOVING INTERACTION BETWEEN ADJACENT FRAMES

The present application is a divisional application of U.S. patent application Ser. No. 06/913,710 filed Sept. 30, 1986, now U.S. Pat. No. 4,776,938.

BACKGROUND OF THE INVENTION

This invention relates to an encoder for use in encoding an input signal into an encoded signal in a data transmission network. The input signal may be either a speech signal or a picture signal, although description will mainly be directed to the speech signal.

It is preferable to reduce transmission rate with an eye to reducing cost of a data transmission network since, for higher rates, a larger capacity of memory is indispensable to the network due to the transmission of a large number of information signals resulting from an input signal. A recent demand is directed to the transmission rate of 16 kbits/sec rather than 32 kbits/sec.

In general, each of voiced and unvoiced sounds, such as vowels, nasals, fricatives, and the like, can be represented by a convolution between an impulse generated by a sound source and an impulse response of a vocal tract, as well known in the art. The impulse is usually represented by the Kronecher's delta and includes a pitch pulse generated in response to each voiced sound. In other words, each sound is specified by the impulse and can be reproduced by allowing the impulse to pass through a filter having an impulse response similar to that of the vocal tract.

A speech coder of the type described is proposed in an article which is contributed by Bishnu S. Atal et al of Bell Laboratories to Proc. IASSP, 1982, pages 614–617, under the title of "A New Model of LPC Excitation for Producing Natural-sounding Speech at Low Bit Rates." According to the Atal et al article, each impulse is derived as an excitation pulse from each discrete speech signal within a frame of, for example, 20 milliseconds, formed by dividing the input signal. Pulse instants or locations of the excitation pulses and amplitudes thereof are determined by a so-called analysis-by-synthesis (A-b-S) method. It is believed that the model of Atal et al is useful to reduce the transmission rate. The model, however, requires a great amount of calculation in determining the pulse instants and the pulse amplitudes.

In the meanwhile, a "voice coding system" is disclosed in U.S. patent application Ser. No. 565,804 filed Dec. 27, 1983, U.S. Pat. No. 4,716,592, by Kazunori Ozawa et al for assignment to the present assignee. The voice or speech coding system of the Ozawa et al patent is for coding a discrete speech signal sequence of the type described into an encoded signal.

In the speech coding system of the Ozawa et al patent, the amplitude and the pulse instant of each excitation pulse are determined at each frame with reference to both of an autocorrelation of an impulse response of an analyzer and a cross-correlation between the input signal and the impulse response of the analyzer.

More particularly, the input signal can be synthesized by linear combinations of impulses, such as the pitch pulses, and the impulse responses of the analyzer, respectively, when the analyzer exhibits the same impulse response as those of the vocal tract. For simplicity of description, distinction will not be made as regards the relation between the impulse response of the analyzer and those of the vocal tract any longer on the assumption that the analyzer and the vocal tract have the same impulse responses.

Under the circumstances, the cross-correlation between the input signal and the impulse response of the analyzer is specified by a sequence of scalar products of the pitch pulses and an autocorrelation of the impulse response and has a succession of peaks corresponding to the pitch pulses. In other words, the above-mentioned cross-correlation can be represented by the autocorrelation of the impulse response and the excitation pulses placed at the peaks with the amplitudes of the excitation pulses identical with those of the peaks, respectively.

Practically, one of the excitation pulses is determined in each frame by searching for a maximum one of the peaks and is multiplied by each autocorrelation to calculate one of the products. The calculated one of the products is subtracted from the cross-correlation. The resultant or remaining cross-correlation is thereafter subjected to similar processing to successively determine the remaining excitation pulses.

With the system according to the Ozawa et al patent, instants of the respective excitation pulses and amplitudes thereof are determined or calculated with a drastically reduced amount of calculation. The system is, however, not enough to encode actual original speech signals because no consideration is paid to interaction between two adjacent frames.

More particularly, the actual original speech signals continuously run through a plurality of frames. This means that any one of the pitch pulses, may be produced at an end of a current one of the frames, wherein the current frame is succeeded by a following one of the frames. In this event, an impulse response which results from the pitch pulse remains largely within the following frame as a remnant impulse response. Inasmuch as the excitation pulses are determined and calculated at every frame in the speech coding system mentioned above, the remnant impulse response may cause any undesired excitation pulses to occur in the following frame. Accordingly, such undesired excitation pulses may be added to desired excitation pulses in the following frame.

Inasmuch as the remnant impulse response usually lasts for a significant portion of each frame, the quality of the reproduced voice or speech is inevitably degraded by occurrence of the undesired excitation pulses.

SUMMARY OF THE INVENTION

It is an object of this invention to provide an encoder which is capable of improving the quality of reproduced voice.

It is another object of this invention to provide an encoder of the type described, wherein interaction between two adjacent frames can be avoided when a pitch pulse appears at an end of a current frame and causes a remnant response sequence to occur in the following frame.

An encoder to which this invention is applicable is for use in encoding an input signal into an encoded signal with reference to an autocorrelation signal and a cross-correlation signal which are internally produced to specify autocorrelation and cross-correlation related to the input signal, respectively. According to this invention, the encoder comprises a control signal generator responsive to the encoded signal and the autocorrelation signal, for producing a control signal in consideration of the autocorrelation signal. The system further includes an adjusting means for adjusting the cross-correlation signal in response to the control signal to produce an adjusted cross-correlation signal. Also, the system has an output means responsive to the adjusted cross-correlation signal and the autocorrelation signal for producing the encoded signal.

DESCRIPTION OF THE PREFERRED EMBODIMENT

Principle of the Invention

An encoder according to this invention comprises a spectrum analyzer (to be described later) having an impulse response, similar to that of the Ozawa et al patent referenced in the background description of the instant specification. Calculation is made about an autocorrelation of the impulse response and a cross-correlation between the input signal and the impulse response in the manner described in the Ozawa et al patent.

According to this invention, the autocorrelation of the impulse response, and the cross-correlation between the input signal and the impulse response are calculated in consideration of both of the current frame and a part of the following frame. As a result, the amplitude and the pulse instant of each of the excitation pulses are determined with reference to the current frame and the part of the following frame. Part of the following frame has a time interval dependent on the impulse response.

In this event, the excitation pulses may appear in the current frame and the part of the following frame, as a first and a second portion of the excitation pulses, respectively. Only the first portion of the excitation pulses is encoded into an encoded signal with the second portion thereof removed. This operation will be referred to as a first stage of operation.

Taking the second portion of the excitation pulses into consideration, some influence or interaction be exerted on an end part of the current frame by the second portion of the excitation pulses and such will be called an end part interaction. The end part interaction is eliminated in the first stage of operation because the excitation pulses are determined in consideration of the following frame in addition to the current frame.

On the other hand, the autocorrelation concerned with the part of the following frame may be named a remnant portion and is subtracted from the cross-correlation calculated in relation to the following frame at a second stage of operation. Subtraction of the remnant autocorrelation is carried out at a front part, namely, the part of the following frame. As a result, any influence on the front part of the following frame can be eliminated in the second stage of operation.

Similar operation is successively carried out with respect to each succeeding frame by repeating the first and the second stages of operation. The encoder can therefore produce a pure sequence of the excitation pulses exempted from any interactions resulting from adjacent frames.

Embodiment

Figure 1:
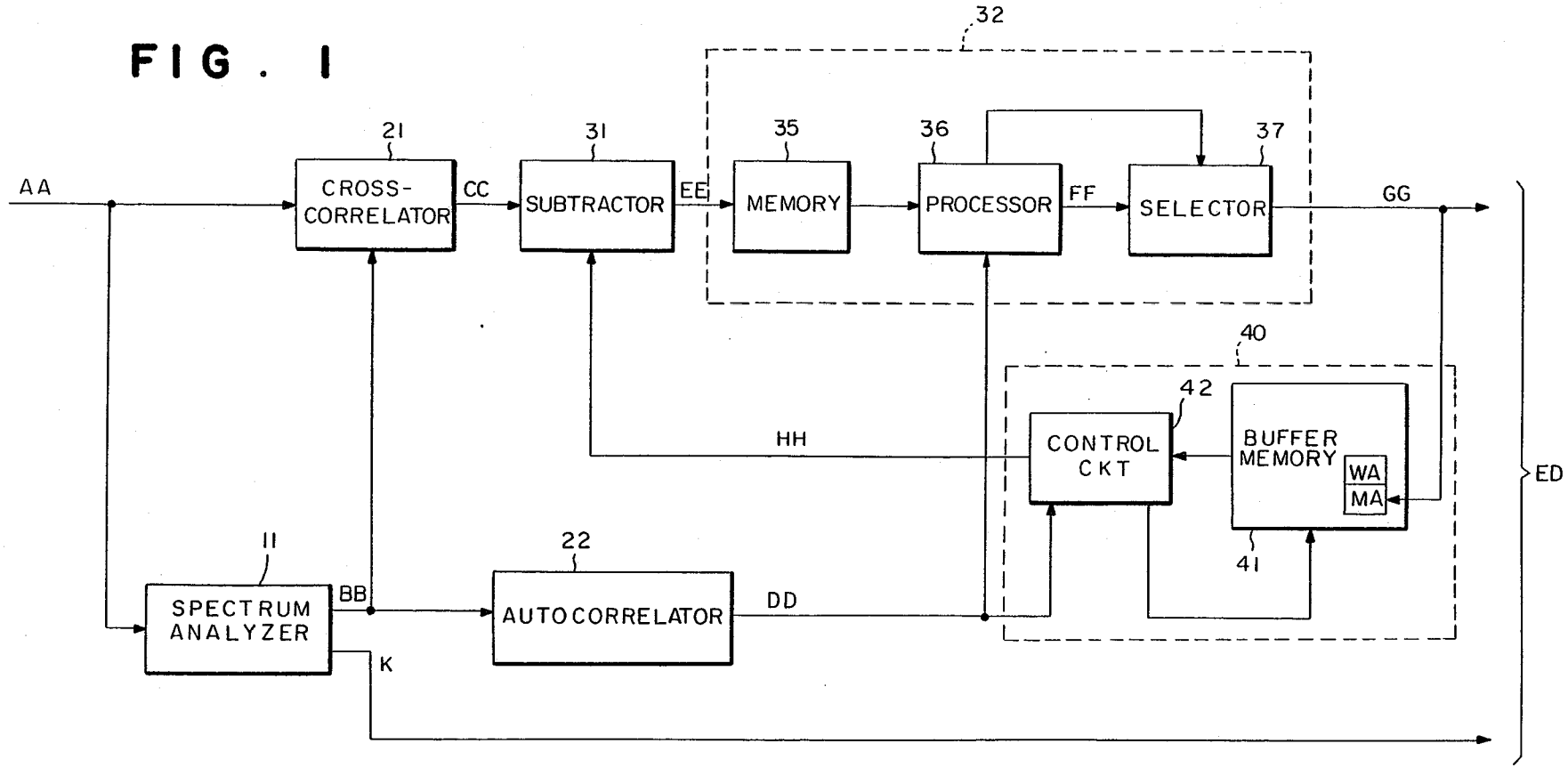
FIG. 1 is a block diagram of an encoder according to a preferred embodiment of this invention.
Figure 2:
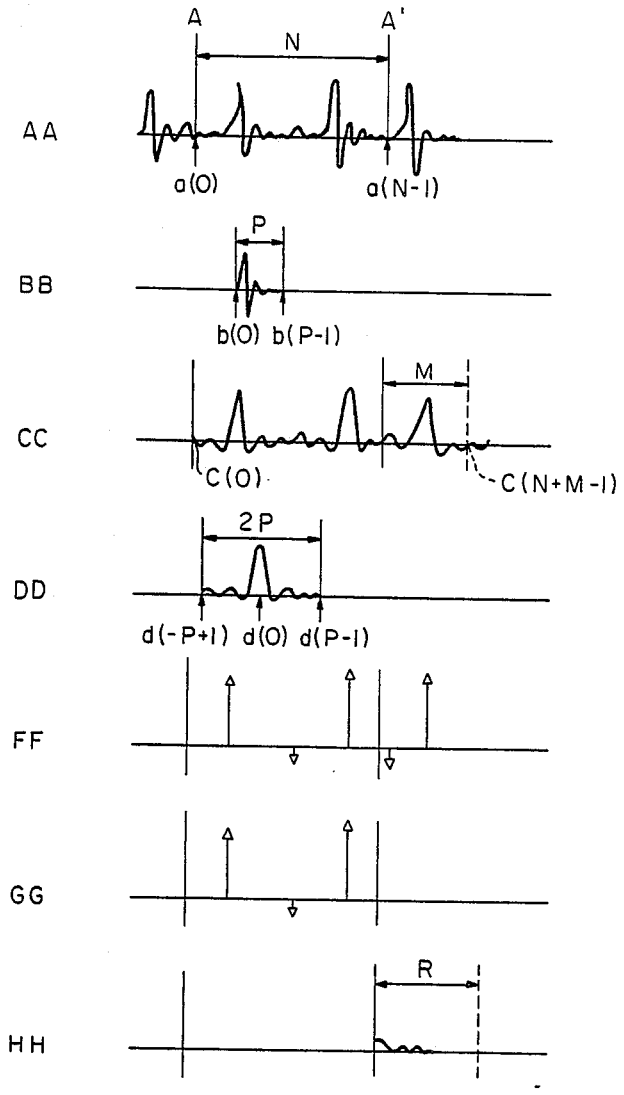
FIG. 2 is a time chart for use in describing operation of the encoder illustrated in FIG. 1.

Referring to FIGS. 1 and 2, an encoder according to an embodiment of this invention is supplied with an input speech signal AA, as exemplified by the same reference symbol in FIG. 2. The speech signal AA is given from a preliminary buffer (not shown) in the manner which will later be described. As shown in FIG. 2, the speech signal AA is divisible into a succession of frames one of which is partitioned by a pair of lines A and A′ and which will be called a current frame. The current frame is succeeded by a following frame illustrated on the righthand side of the current frame in FIG. 2. It is assumed that each frame lasts for a time interval of, for example, 20 milliseconds and consists of N samples which may be consecutively numbered from a first through an N-th sample. In other words, each frame lasts for N-sampling instants. When the samples are obtained at a sampling frequency of 8 kHz, N is equal to 160. The N samples for the speech signal are consecutively numbered from a zeroth speech sample, a(0), to an (N−1)-th speech sample, a(N−1).

Figure 3:
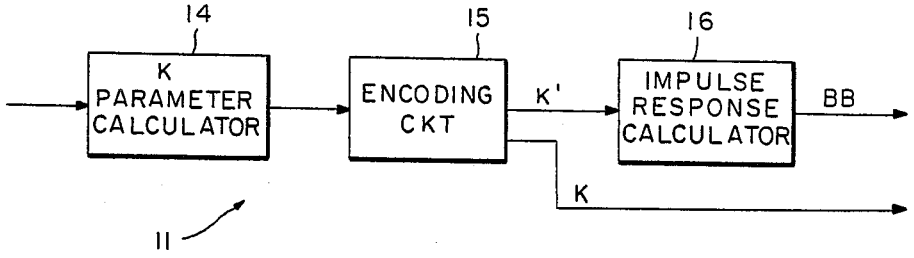
FIG. 3 is a block diagram of a spectrum analyzer for use in the encoder.

Referring to FIG. 3 together with FIG. 1, the original speech signal AA is delivered to a spectrum analyzer 11 comprising a K parameter calculator 14, an encoding circuit 15, and an impulse response calculator 16. Supplied with the speech signal AA during the current frame, the K parameter calculator 14 calculates a sequence of K parameters representative of a spectral envelope of the samples. The K parameter calculator 14 may carry out calculation in the manner described in an article which is contributed by J. Makhoul to Proc. IEEE, April 1975, pages 561–580, and which is given a title of "Linear Prediction: A Tutorial Review."

The encoding circuit 15 is for encoding the K parameter sequence into an encoded parameter sequence K of a predetermined number of quantization bits. The encoding circuit 15 may be of the circuitry described in an article contributed by R. Viswanthan et al to IEEE Transactions on Acoustics, Speech, and Signal Processing, June 1975, pages 309–321, and entitled "Quantization Properties of Transmission Parameters in Linear Predictive Systems." The encoding circuit 15 furthermore decodes the encoded parameter sequence K into a sequence of decoded parameters K′ which correspondence to the respective K parameters. The decoded parameter sequence K′ is fed to the impulse response calculator 16 which calculates an impulse response within the current frame to produce an impulse response signal BB representative of the impulse response as shown in FIG. 2. Specifically, the impulse response calculator 16 may be a combination of a weighting circuit, a parameter converter for conversion of the encoded parameter sequence, and an impulse generator, which are all described in the Ozawa et al patent application referenced in the background description of the instant specification.

The impulse response signal BB may be determined in consideration of both of the current frame and a part of the following frame. The part of the following frame will become clear as the description proceeds. The impulse response signal BB has a length equal to p pulse instants as illustrated in FIG. 2, where p is usually smaller than N. The impulse response signal BB may be consecutively divisible into zeroth through (p−1)-th response components which are represented by b(0) through b(p−1), respectively, as illustrated in FIG. 2. The response components b(0) to b(p−1) may be, for example, PARCOR coefficients. The number p may be greater than N when the impulse response to be calculated is longer than the frame. The impulse response signal BB is sent to a cross-correlator 21 and an autocorrelator 22 both of which are illustrated in FIG. 1.

Figure 4:
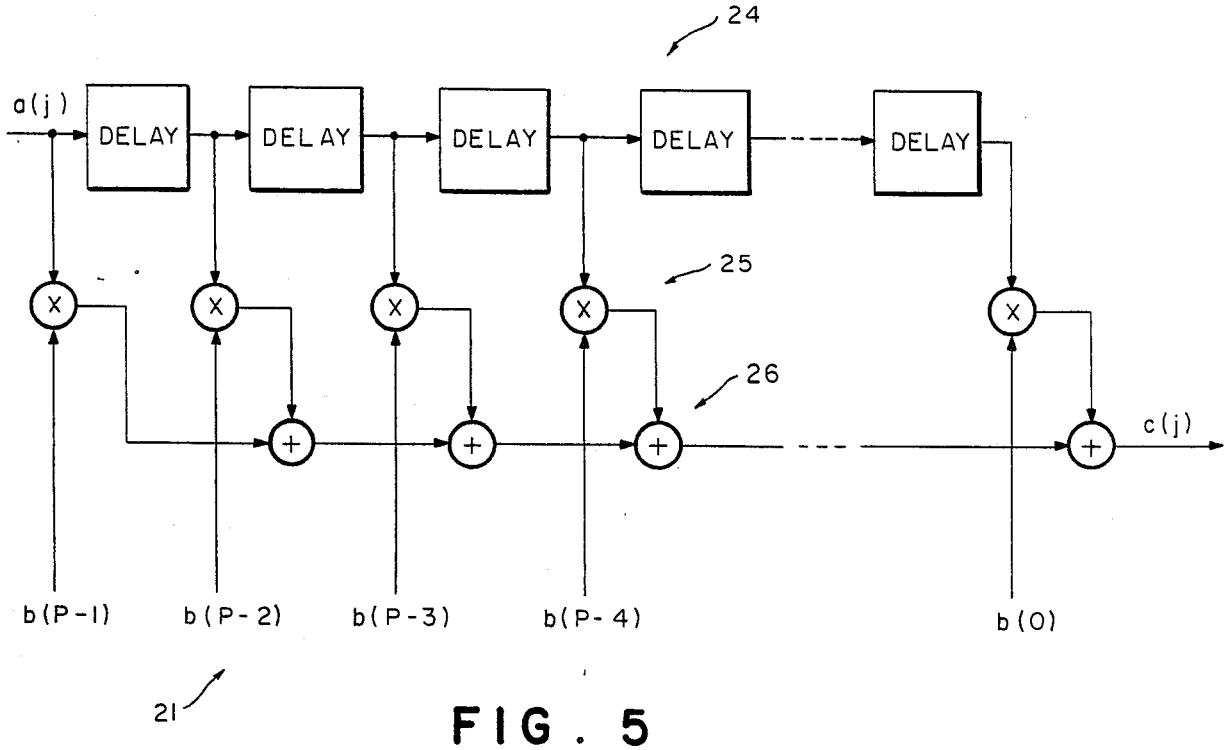
FIG. 4 is a block diagram of a cross-correlator for use in the encoder illustrated in FIG. 1.

Referring to FIG. 4 as well as FIGS. 1 and 2 again, the cross-correlator 21 calculates cross-correlation between the input speech signal AA and the impulse response signal BB to produce a cross-correlation signal CC representative of the cross-correlation as illustrated in FIG. 2. It is to be noted here that the illustrated cross-correlator 21 calculates the cross-correlation in consideration of both of the current frame and the part of the following frame. The part of the following frame lasts for M sampling instants where M is an integer selected with reference to the impulse response of the spectrum analyzer 11 as depicted in FIG. 2.

In order to carry out the above-mentioned calculation of the cross-correlation, the cross-correlator 21 is given the zeroth through (N+M−1)-th speech samples a(0) to a(N+M−1) in synchronism with a single one of frame pulses produced in the known manner. Similar operation is carried out in the following frame. This means that the M speech samples in the part of the following frame are twice read out of the preliminary buffer.

More specifically, the cross-correlation is given in the form of convolutions between the speech samples and the components b(0) to b(p−1) and is therefore represented by:

$$C(j) = \sum_{i=0}^{p-1} a(j+1) \cdot b(p-1-i), \tag{1}$$

where C(j) is representative of a cross-correlation sample calculated at a j-th sampling instant which is variable between the zeroth sampling instant and an (N+M−1)-th sampling instant, both inclusive.

Equation (1) is realized by a combination of delay registers (DELAY), multipliers, and adders which are collectively indicated in FIG. 4 at 24, 25, and 26, respectively. The number of the delay registers 24 is equal to (p−1). Each delay register 24 serves to delay each speech sample a (suffixes omitted) by one sample time. Delayed speech samples are fed together with each speech sample a(j) to the multipliers 25 which are equal in number to p and which are supplied with the zeroth through (p−1)-th components b(0) to b(p−1) in a known manner. The multipliers 25 deliver products of the speech and the delayed speech samples and the response samples to the adders 26, (p−1) in number.

Similar operation is carried out with respect to the current frame during the zeroth through (N+M−1)-th sampling instants to calculate zeroth through (N+M−1)-th ones of the cross-correlation samples C(0) to C(N+M−1), respectively, as illustrated in FIG. 2. It is noted here that the impulse response signal BB is supplied to the multipliers 25 during the (N+M)-sampling instants to calculate the cross-correlation samples C(0) to C(N+M−1) in conjunction with the current frame.

Figure 5:
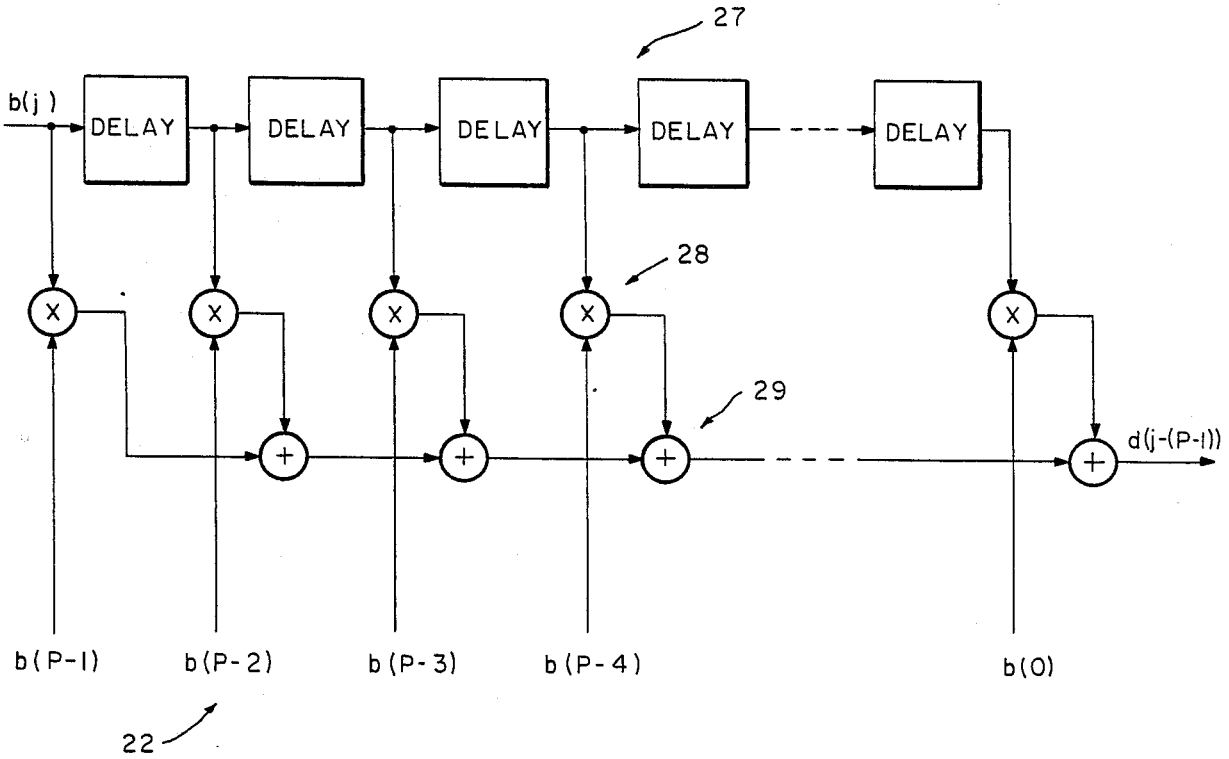
FIG. 5 is a block diagram of an autocorrelator for use in the encoder.

Referring to FIG. 5 together with FIGS. 1 and 2, the autocorrelator 22 is supplied with the impulse response signal BB to calculate autocorrelation of the impulse response signal BB and to produce an autocorrelation signal DD representative of the autocorrelation as illustrated in FIG. 2. The autocorrelation signal DD is produced in relation to the current frame and the part of the following frame. In other words, the autocorrelation signal DD is kept for the current frame and the part of the following frame.

More particularly, the autocorrelation is given in the form of convolutions of the impulse response signal BB by:

$$d(m-(p-1)) = \sum_{i=0}^{p-1} b(i) \cdot b(i+m), \tag{2}$$

where d(m−(p−1)) is representative of an autocorrelation component calculated at an instant (m−(p−1)) and m is variable between zero and (2p−1), both inclusive. Equation (2) is realized by a circuit as exemplified in FIG. 5. The impulse response calculator 16 stationarily delivers the zeroth through (p−1)-th response component b(0) to b(p−1) to the autocorrelator 22 on one hand and successively delivers each response component b(j) thereto on the other hand.

The autocorrelator 22 is similar in structure to the cross-correlator 21. Responsive to each response component b(j), delay registers 27 successively delay each response component b(j) to produce delayed response components. The delayed response components and each response component b(j) are fed to multipliers 28 which are supplied with the response components b(0) through b(p−1) to calculate products of two response components, respectively. The products are added by adders 29 to produce the autocorrelation component d(j−(p−1)) or d(k) as a part of the autocorrelation signal DD. Similar calculation is carried out from zero to (2p−1) to produce the autocorrelation signal DD as illustrated in FIG. 2. The autocorrelation signal DD is kept for the zeroth through (N+M−1)-th sampling instants.

It is also possible to calculate the cross-correlation and the autocorrelation by the use of a microprocessor.

Referring back to FIG. 1, the cross-correlation signal CC is fed through a subtractor 31 (to be later described) to an excitation pulse generator 32 as an adjusted cross-correlation signal EE which will be described in conjunction with the subtractor 31. The autocorrelation signal DD is also fed to the excitation pulse generator 32. The excitation pulse generator 32 is operable to process the adjusted cross-correlation signal EE and the autocorrelation signal DD in a manner similar to that described in the above-referenced Ozawa et al patent. For this purpose, the excitation pulse generator 32 comprises a memory 35 and a processor 36 both of which will presently be described.

Figure 6:
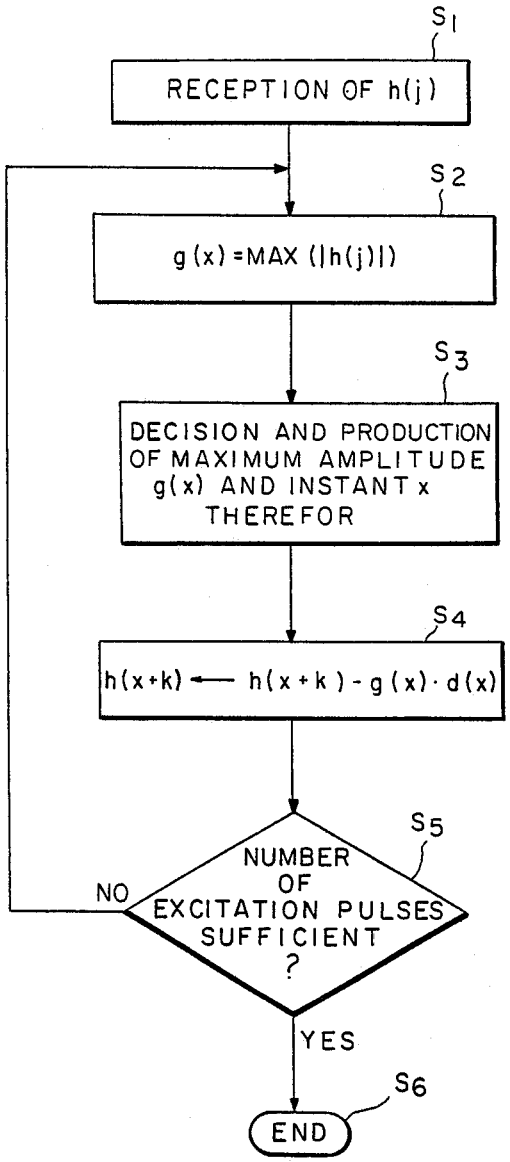
FIG. 6 is a flow chart for use in describing operation of an excitation pulse generator included in the encoder.

Referring to FIG. 6 together with FIGS. 1 and 2, operation of the excitation pulse generator 32 will be described in detail. It is to be noted here that the adjusted cross-correlation signal EE concerned with the current frame appears from the zeroth sampling instant to the (N+M−1)-th sampling instant like the cross-correlation signal CC mentioned before. The adjusted cross-correlation signal EE may therefore be specified by a zeroth adjusted cross-correlation component, h(0), through an (N+M−1)-th adjusted cross-correlation component, h(N+M−1), which may be represented by h(j), where j is variable between zero and (N+M−1), both inclusive. The adjusted cross-correlation components h(j) have variable amplitudes.

When the adjusted cross-correlation components h(j) are stored in the memory 35 at a first step $S_1$ of FIG. 6, the processor 36 reads the adjusted cross-correlation components h(j) out of the memory 35 and calculates absolute values of the adjusted cross-correlation components h(j) to search for a maximum one of the absolute values at a second step $S_2$. The absolute values will be represented by |h(x)| where x is representative of a pulse instant between zero and N+M−1, both inclusive. The maximum of the absolute values will be indicated by g(x) and will be called a maximum amplitude.

The second step $S_2$ is followed by a third step $S_3$ for deciding the maximum amplitude g(x) and the pulse instant x of the maximum absolute value concerned with the current frame and the part of the following frame. At the third step $S_3$, a single pulse is produced as one of primitive pulses FF at the pulse instant x with an amplitude of the one primitive pulse identical with the amplitude g(x). The primitive pulses FF may be considered as the excitation pulses described in conjunction with the principle of the invention. Accordingly, the primitive pulses FF are divisible into first and second portions falling within the current frame and the part of the following frame.

At a fourth step $S_4$, a peak amplitude of the autocorrelation signal DD is adjusted to the maximum amplitude g(x) by reducing or expanding the peak amplitude of the autocorrelation signal DD. Multiplication is thereafter carried out between the maximum amplitude g(x) and the autocorrelation components d(k) to produce products therebetween which will be referred to as an adjusted autocorrelation signal g(x)·d(k) concerned with the pulse instant x.

Subsequently, the adjusted autocorrelation signal g(x)·d(k) is subtracted from selected ones of the adjusted cross-correlation components h(j) that fall within the pulse instants or locations specified by (x+k). The above-mentioned subtraction results in reducing the maximum amplitude of the adjusted cross-correlation components h(j) within the pulse instants (x+k). The remaining or reduced adjusted cross-correlation components are kept in the memory 35.

At a fifth step $S_5$, the processor 35 judges whether or not the number of the primitive pulses FF is enough to encode the speech signal AA. The judgement is possible, for example, by monitoring electric power or a signal to noise ratio of the remaining adjusted cross-correlation signal CC or components h(j).

On production of an insufficient number of the primitive pulses, the fifth step $S_5$ returns to the second step $S_2$ to search for a next maximum one of the absolute values from the remaining adjusted cross-correlation signal CC. A next one of the primitive pulses is determined at the ensuing steps in the manner mentioned above.

When the number of the primitive pulses FF reaches a sufficient number by repetition of the above-mentioned operation, the excitation pulse generator 32 stops the operation which is concerned with the current frame, as shown at a sixth step $S_6$ in FIG. 6.

The primitive pulses FF are produced in connection with the current frame under control of the processor 36 in consideration of the zeroth to the (N+M−1)-th ones of the adjusted cross-correlation components, as exemplified at FF in FIG. 2.

The illustrated excitation pulse generator 32 further comprises a selector 37 for selecting only the first portion of the primitive pulses FF located within the current frame as a sequence of excitation pulses GG, as exemplified in FIG. 2. The excitation pulse sequence GG is produced as a first one of encoded signals ED.

Thus, amplitudes and pulse instants of the excitation pulse sequence GG are determined in consideration of both of the current frame and the part of the following frame, as described in conjunction with the primitive pulses FF. In addition, the excitation pulse sequence GG is accompanied by no second portion of the primitive pulses FF concerned with the part of the following frame. It is therefore possible to avoid an interaction exerted on an end part of the current frame by the second portion of the primitive pulses FF appearing in the part of the following frame, as mentioned before.

At any rate, the excitation pulse generator 32 serves to carry out the first stage operation in cooperation with the cross-correlator 21 and the autocorrelator 22 and may be called an output circuit for producing the first encoded signal.

The encoded parameter sequence K is produced as a second one of the encoded signals ED. The first and the second encoded signals ED are sent through another encoding circuit (not shown) to a decoder (not shown also) as an output code sequence.

Figure 7:
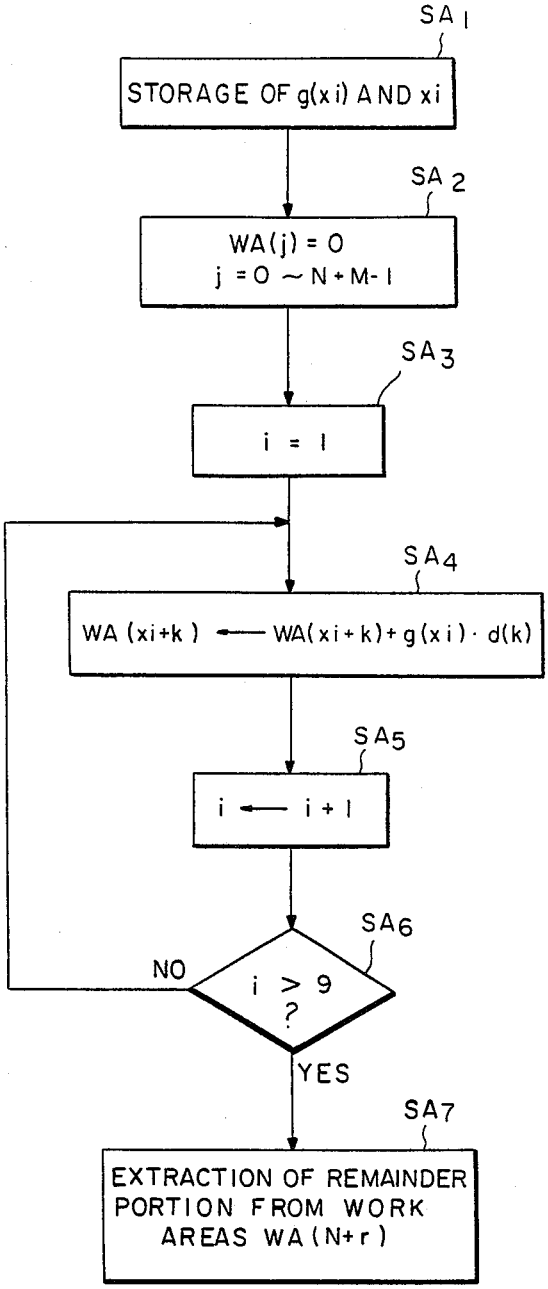
FIG. 7 is a flow chart for use in describing operation of a cross-correlation controller used in the encoder.

Referring to FIGS. 1 and 2 again and FIG. 7, the illustrated encoder further comprises a cross-correlation controller 40 responsive to the excitation pulse sequence GG. The cross-correlation controller 40 comprises a buffer memory 41 having a plurality of work areas (WA) consecutively numbered from a zeroth work area to an (N+M−1)-th one for the zeroth through the (N+M−1)-th pulse instants, respectively. In addition, the buffer memory 41 has a plurality of memory areas (MA) for successively memorizing the amplitude g(x) and the pulse instant x of each excitation pulse GG.

In order to specify an order of the excitation pulses concerned with the current frame and the part of the following frame, a suffix i is attached to each pulse instant x and will be called an index, where i is variable between unity and q, both inclusive. The number q is representative of the number of the excitation pulses GG located in the current frame.

In FIG. 7, the excitation pulses $g(x_i)$ and the pulse instants $x_i$ are stored under control of a control circuit 42 in memory addresses of the memory area MA, as shown at a first additional step $SA_1$. On the other hand, all of the work areas ($WA_j$) are cleared as illustrated at a second additional step $SA_2$.

Under the circumstances, the control circuit 42 indicates i=1, as illustrated at a third additional step $SA_3$ to specify a first one of the excitation pulses GG stored in the buffer memory 41. As a result, the amplitude $g(x_1)$ and the pulse instant $x_1$ are read out of the buffer memory 41.

The control circuit 42 carries out calculation shown at a fourth additional step $SA_4$. More particularly, the amplitude $g(x_1)$ of the first excitation pulse is multiplied by the autocorrelation signal DD represented by d(k). Multiplications are carried out by successively varying k from minus (p−1) to plus (p−1) to calculate products of the amplitude $g(x_1)$ and the autocorrelation components d(k). The products are successively stored in the work areas $WA(x_i+k)$ of the buffer memory 41 and will be referred to as a modified autocorrelation concerned with the first excitation pulse.

Subsequently, the control circuit 42 renews the index i into (i+1) by adding unity to the index i to indicate a following one of the excitation pulses GG, as illustrated at a fifth additional step $SA_5$. At a sixth additional step $SA_6$, a renewed index is compared with the number q by the control circuit 42. If the renewed index does not exceed the number q, the fourth additional step $SA_4$ is carried out with respect to the following excitation pulse in the above-mentioned manner.

At any rate, all of the excitation pulses GG are processed to calculate the modified autocorrelation in the above-mentioned manner. Inasmuch as the excitation pulses GG are located in the current frame, the modified autocorrelations are partly vestigial or left in the part of the following frame as a remnant portion as illustrated at HH in FIGS. 1 and 2. The remnant portion is stored in work areas specified by WA(N+r), where r is a variable integer between zero and R and where, in turn, R is an integer equal to or greater than M.

At a seventh additional step $SA_7$, the remnant portion HH is extracted as the control signal from the work areas (W+r) to be stored in the buffer memory 41.

The control signal is read out of the buffer memory 41 to be delivered to the subtractor 31 in timed relation to the cross-correlation signal CC, namely, the zeroth through (N+M−1) cross-correlation components of the following frame which are sent from the preliminary buffer. The subtractor 31 subtracts the control signal from the cross-correlation components of the following frame to produce a difference signal representative of a difference between the cross-correlation signal CC of the following frame and the control signal. The difference signal is fed to the excitation pulse generator 32 as the adjusted cross-correlation signal EE of the following frame. Thus, the second stage of operation mentioned in conjunction with the principle of the invention is carried out to eliminate an influence or interaction exerted on a front part of the following frame by the current frame.

While this invention has thus far been described in conjunction with a preferred embodiment thereof, it will readily be possible for those skilled in the art to put this invention into practice in various other manners. For example, each frame has a variable length. A length of the impulse response BB may adaptively be variable so as to vary the numbers R and M. This invention is applicable to an encoder of carrying out encoding without production of any excitation pulses.

What is claimed is:

1. An encoder for encoding an input signal into an encoded signal by the use of an autocorrelaton signal and a cross-correlation signal which are internally produced to specify autocorrelation and cross-correlation related to said input signal, respsectively, said input signal carrying a plurality of speech samples placed within both of a current frame and a part of a following frame, said encoder comprising:

impulse response deriving means responsive to said input signal for deriving an impulse response from said plurality of the speech samples of said input signal to produce an impulse response signal representative of said impulse response;

cross-correlation calculating means responsive to said input signal and said impulse response signal for calculating cross-correlation between said input signal and said impulse response signal in relation to said plurality of the speech samples for said current frame and said part of the following frame to produce a cross-correlation signal representative of the cross-correlation between said input signal and said impulse response signal;

autocorrelation calculating means coupled to said impulse response deriving means for calculating autocorrelation of said impulse response signal to produce an autocorrelaton signal representative of said autocorrelation;

control signal producing means responsive to said encoded signal and said autocorrelation signal for producing a control signal related to the autocorrelation of said part of the following frame;

subtracting means coupled to said cross-correlation calculating means and said control signal producing means for subtracting said control signal from said cross-correlation signal to produce a difference signal representative of a difference between said cross-correlation signal and said control signal, said difference signal being produced for said part of the following frame; and processing means coupled to said subtracting means and said autocorrelation calculating means for processing said difference signal and said auto-correlation signal into said encoded signal produced only for said current frame.

2. An encoder as claimed in claim 1, wherein said processing means comprises:

pulse producing means responsive to said difference signal and said autocorrelation signal for producing a sequence of primitive pulses produced for said current frame and said part of the following frame;

selecting means coupled to said pulse producing means for selecting only the primitive pulse sequence produced from said current frame as an excitation pulse sequence; and means for producing said excitation pulse sequence as said encoded signal.

3. An encoder as claimed in claim 2, wherein said control signal producing means comprises:

means responsive to said excitation pulse sequence and said autocorrelation signal for producing a partial signal produced for said part of the following frame; and means for supplying said subtracting means with said partial signal as said control signal.

forming a non-magnetic underlayer made of a non-magnetic material on a disc-shaped substrate by carrying out a physical vapor deposition by use of a mask having an opening with a predetermined diameter so that grains of the non-magnetic material grow and become oriented in a circumferential direction of said substrate, said mask being arranged substantially coaxially to said substrate, and forming a magnetic layer made of a magnetic material on said non-magnetic underlayer by carrying out a physical vapor deposition, said magnetic layer having a magnetic easy axis thereof oriented in the circumferential direction of said substrate.

* * * * *

UNITED STATES PATENT AND TRADEMARK OFFICE

CERTIFICATE OF CORRECTION

PATENT NO. : 4,809,330

DATED : February 28, 1989

INVENTOR(S) : Shunji TANAKA et al

It is certified that error appears in the above—identified patent and that said Letters Patent is hereby corrected as shown below:

On the title page, item [62] delete "Related U.S. Application Data Division of Ser. No. 913,710, Sep. 30, 1986, Pat. No. 4,776,938.".

Column 1, lines 5-7, delete in their entirety.

Column 2, line 30, delete ",".

Column 3, line 48, delete "the" (first occurrence).

Column 10, lines 31 and 32, "auto-correlation" should read --autocorrelation--.

Column 10, line 32, after "signal" (first occurrence) insert --processing--.

Column 10, lines 54-66, delete in their entirety.

Signed and Sealed this

Fourth Day of August, 1992

*Attest:*

DOUGLAS B. COMER

*Attesting Officer*

*Acting Commissioner of Patents and Trademarks*